US011611139B2

(12) United States Patent
Toth et al.

(10) Patent No.: US 11,611,139 B2
(45) Date of Patent: Mar. 21, 2023

(54) MOUNTING SYSTEMS FOR A WIRELESS NETWORK DEVICE

(71) Applicant: Verizon Patent and Licensing Inc., Basking Ridge, NJ (US)

(72) Inventors: Andrew Nicholas Toth, Telford, PA (US); Robert Stewart, Point Pleasant, NJ (US); Serge Van Steenkiste, Somerset, NJ (US); Christopher Emmons, Stratford, NJ (US); Walid Nabhane, Long Valley, NJ (US); Ming-Hung Hung, Hsinchu (TW); Jhan-Li Wu, Wujie Township (TW); Reid Schlegel, Oradell, NJ (US)

(73) Assignee: Verizon Patent and Licensing Inc., Basking Ridge, NJ (US)

( * ) Notice: Subject to any disclaimer, the term of this patent is extended or adjusted under 35 U.S.C. 154(b) by 0 days.

(21) Appl. No.: 17/304,994

(22) Filed: Jun. 29, 2021

(65) Prior Publication Data

US 2022/0416398 A1 Dec. 29, 2022

(51) Int. Cl.

| | |
|---|---|
| ***H01Q 1/12*** | (2006.01) |
| ***H01Q 1/42*** | (2006.01) |
| ***H01Q 1/24*** | (2006.01) |

(52) U.S. Cl.
CPC ..... *H01Q 1/1221* (2013.01); *H01Q 1/247* (2013.01); *H01Q 1/42* (2013.01)

(58) Field of Classification Search
CPC ..... H01Q 1/1221; H01Q 1/247; H01Q 1/42
See application file for complete search history.

(56) References Cited

FOREIGN PATENT DOCUMENTS

| | | | | | |
|---|---|---|---|---|---|
| CN | 206212521 U | * | 5/2017 | ..... | H05K 7/20 |
| CN | 207053488 U | * | 2/2018 | ..... | B60R 11/0241 |
| CN | 110492216 A | * | 11/2019 | ..... | H01Q 1/02 |
| CN | 211378503 U | * | 8/2020 | ..... | H05K 7/20 |

* cited by examiner

*Primary Examiner* — Hoang V Nguyen

(57) ABSTRACT

A device may include a housing with a plurality of top openings provided in a top portion of the housing and a plurality of bottom openings provided in a bottom portion of the housing. The device may include one or more internal components provided within the housing to provide a wireless service. The device may include a rotation extension connected to the bottom portion of the housing and configured to rotatably attach to a bracket that mounts the device to an object. The device may include a connector connected to the rotation extension and configured to receive a cable that provides communication signals to and from the device.

20 Claims, 10 Drawing Sheets

MOUNTING SYSTEMS FOR A WIRELESS NETWORK DEVICE

BACKGROUND

A wireless network (e.g., a telecommunications network) may require that some devices used to access wireless services be mounted, for example, on vertical surfaces such as a wall or window, in order to best receive and/or transmit wireless signals. As one example, a wireless gateway may be used at a location to communicate over a wide-area wireless network (e.g., an LTE or 5G network), and it may be advantageous to position the wireless gateway on a wall, window or other object that has the best radio frequency reception/transmission characteristics (e.g., line-of-sight to a base station antenna, less physical obstructions to wireless signals, etc.). As another example, a wireless extender (e.g., also known as a wireless network repeater or a wireless network booster), may be desirable for locations where wireless signals are less strong in order to amplify these wireless signals to reach far corners of the location. The wireless extender may be best positioned for signal reception and transmission by mounting at an elevated height and on an exterior wall, window, etc.

Mounting of these devices can be problematic due to the variation in location environments. For example, the best location for wireless signal receipt/transmission can vary based on base station location, building materials for the location, the elevation location, and the like. In some cases, mounting may be performed by untrained installers that are not familiar with or have access to mounting equipment. Also, in some cases, the location may restrict the kind of mounting that is permitted either by rule or material (e.g., the location owner may prohibit certain types of mounting or the location building material may be difficult for mounting).

DETAILED DESCRIPTION OF EXAMPLE EMBODIMENTS

Figure 1A:
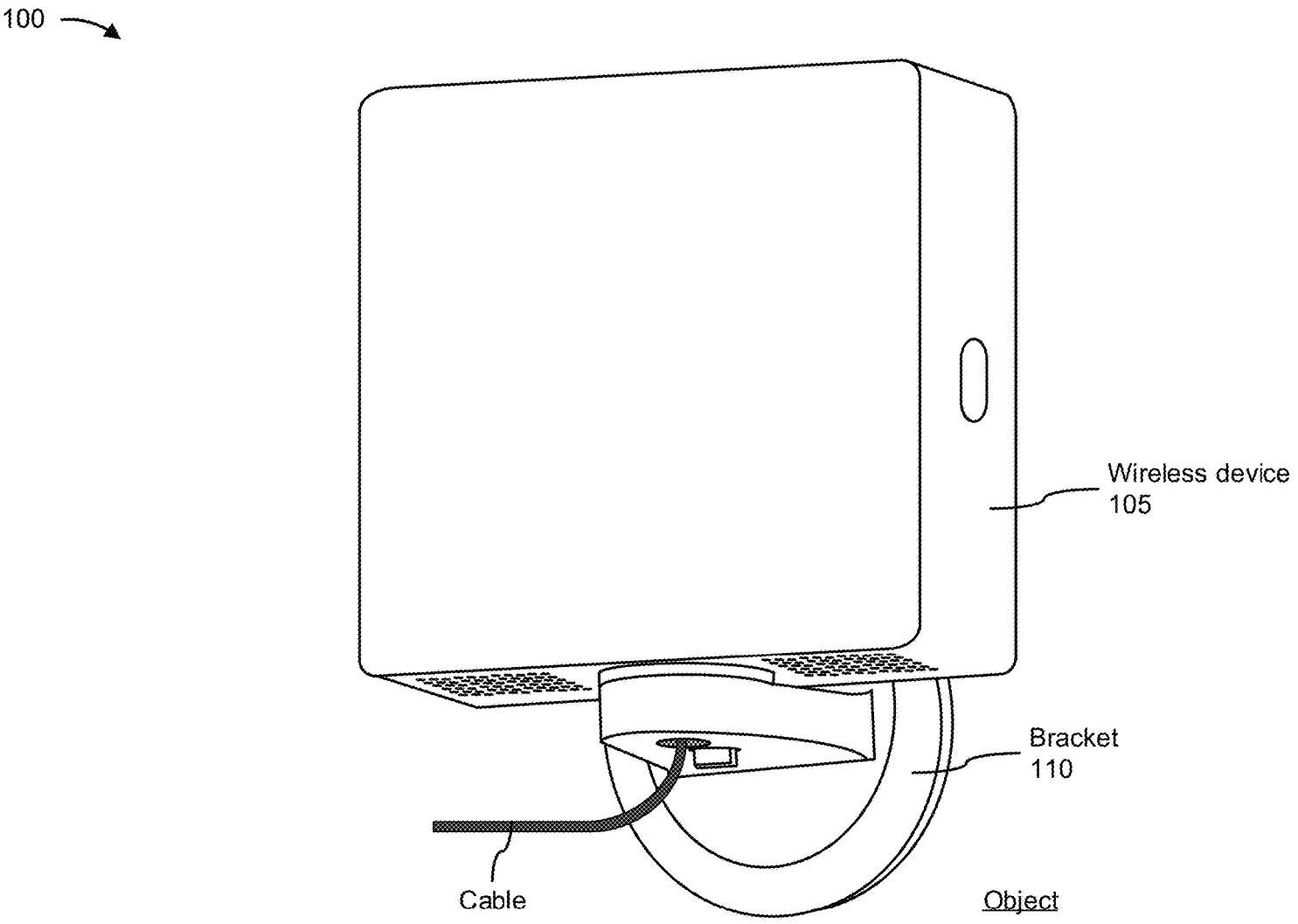
FIGS. 1A-1D are diagrams of an example wireless network device and an example bracket for mounting the wireless network device.

The following detailed description of example implementations refers to the accompanying drawings. The same reference numbers in different drawings may identify the same or similar elements.

A signal strength of a wireless network may vary from one area of a customer premises to another area of the customer premises and, sometimes, from one location to another location within the same area. Different types of obstructions (e.g., an object, such as a wall or a window, and/or a magnetic interference) may affect the signal strength. A user may desire a particular signal strength in each area, of the customer premises, in which the user may be located with a user device. Additionally, or alternatively, the user may desire to determine a signal strength (of the wireless network extender) in each area, of the customer premises, in which the user may be located with the user device. In this regard, the user may physically move the wireless network extender from a first area (in which the user is located with the user device) to a second area (in which the user is subsequently located with the user device), and so on. The process of physically moving the wireless network extender to different locations can be tedious and time consuming. Additionally, each time the wireless network extender is moved from one location to another location, the wireless network extender may be caused to reboot and reconnect with user devices located in the customer premises and/or to an external network (e.g., the Internet).

Thus, current techniques for positioning a wireless network extender consume computing resources (e.g., processing resources, memory resources, communication resources, and/or the like), networking resources, and/or other resources associated with rebooting the wireless network extender, reconnecting with user devices and an external network, losing network traffic during the rebooting and reconnecting with the user devices and the external network, and/or the like.

Some implementations described herein provide a wireless network device (e.g., for a telecommunications network) and a bracket for mounting the wireless network device. For example, the device may include a housing with a plurality of top openings provided in a top portion of the housing and a plurality of bottom openings provided in a bottom portion of the housing. The housing may include one or more internal components provided within the housing (e.g., to provide wireless communications services). The device may include a rotation extension connected to the bottom portion of the housing and configured to rotatably attach to the bracket that mounts the device to an object. The bracket may include a connection portion configured to connect to the object and a mounting portion configured to connect to the connection portion. The bracket may include a body portion configured to connect to the mounting portion and an arm portion connected to the body portion and configured to receive and retain the rotation extension of the wireless network device.

In some implementations, the bracket may space the wireless network device from an object (e.g., to which the bracket is attached) to prevent interference with receipt of a telecommunications signal (e.g., a fifth generation (5G) network signal). The wireless network device may include a 5G receiver and a 5G router built into a single housing. The bracket may include a female locking mechanism that communicates with a male locking mechanism (e.g., connected to a window or a wall) to enable easier installation of the bracket. The bracket may connect to the wireless network device and enable the wireless network device to rotate towards and away from the bracket. Thus, the bracket may enable the wireless network device to be quickly and easily installed and to receive an optimal wireless network signal. In this way, the wireless network device and the bracket may conserve computing resources, networking resources, and other resources that would have otherwise been consumed by rebooting the wireless network device, reconnecting with user devices and an external network, losing network traffic during the rebooting and reconnecting with the user devices and the external network, and/or the like.

FIGS. 1A-1D are diagrams of an example 100 associated with a wireless network device and a bracket for mounting the wireless network device (also referred to as a wireless device). As shown in FIG. 1A, example 100 includes a wireless device 105 and a bracket 110.

The wireless device 105 may include a device to receive a wireless signal from a wireless network, such as a cellular network (e.g., a fifth generation (5G) network, a fourth generation (4G) network, such as a long-term evolution (LTE) network, a third generation (3G) network, a code division multiple access (CDMA) network, a public land mobile network (PLMN), a local area network (LAN), a wide area network (WAN), a metropolitan area network (MAN), a telephone network (e.g., the Public Switched Telephone Network (PSTN)), a local or private wireless network, an ad hoc and/or mesh network, or the like, and/or a combination of these or other types of networks. In some implementations, the wireless device 105 may include one or more radio frequency receivers and radio frequency transmitters (e.g., transceivers). In some implementations, switching and/or routing facilities may be included in the wireless device 105.

The bracket 110 may include a mechanism configured to receive and retain a portion of the wireless device 105. The bracket 110 may connect to an object, such as a window, a wall, a door, and/or the like, so that the wireless device 105 may be mounted to the object. As further shown in FIG. 1A, a cable may be provided through an opening of the bracket 110 and may connect to the wireless device 105 to provide communication signals to and/or from the wireless device 105.

Figure 1B:
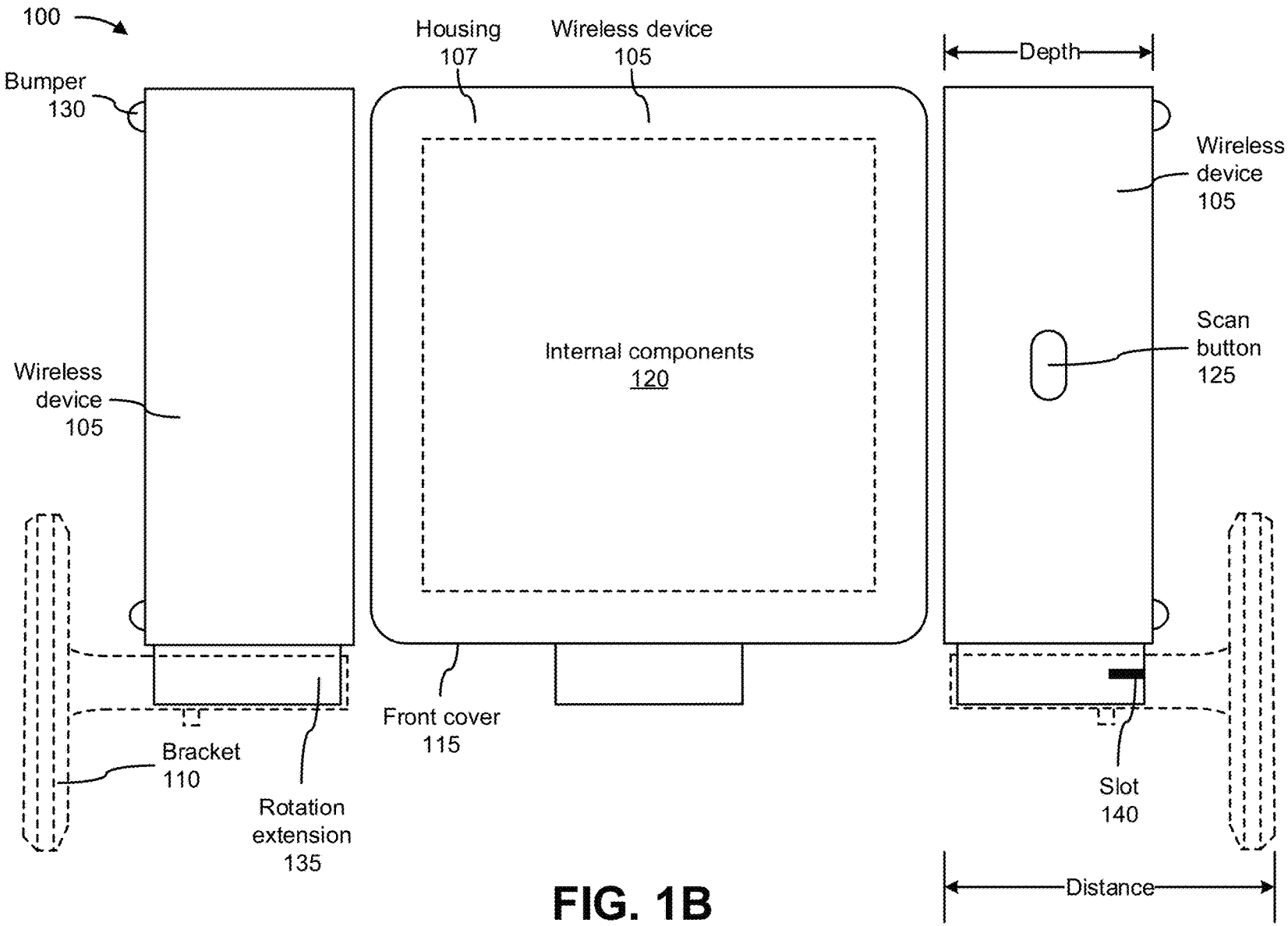

FIG. 1B is a diagram depicting a front view, a left-side view, and a right-side view of the wireless device 105. The bracket 110 is also depicted in dashed lines in the left side view and the right-side view. As shown in FIG. 1B, the wireless device 105 may include a housing 107, which in some embodiments may be formed from a front cover 115 and a rear cover 145 (shown in FIG. 1C). The housing 107 may also include internal components 120, a scan button 125, bumpers 130, a rotation extension 135, and a slot 140.

The housing 107 may be sized and shaped to house the internal components 120 of the wireless device 105. For example, the housing 107 may be sized based on the size of and/or a quantity of the internal components 120 housed within the housing 107. Further details on the size of the housing 107 are provided below. The housing 107 may be square shaped, rectangular shaped, circular shaped, oval shaped, and/or the like. The one or more of the components of housing 107 may be made from a variety of materials that permit radio frequency waves to communicate with the internal components 120, such as, for example, a plastic material, a metal material, a rubber material, and/or the like. As further shown in the right-side view of FIG. 1B, the housing 107 may be configured to provide a depth that accommodates the internal components 120. In some embodiments, the depth may be from approximately forty-six millimeters to approximately fifty-two millimeters, a width of approximately forty-nine millimeters, and/or the like, which may accommodate internal components associated with providing 5G wireless service.

The internal components 120 may include components that enable the wireless device 105 to transmit and receive a wireless signal. For example, the internal components 120 may include one or more components capable of receiving, processing, storing, routing, and/or providing traffic (e.g., a packet and/or other information or metadata) in a manner described herein. The internal components 120 may enable the wireless device 105 to function as a receiver, a router, such as a label switching router (LSR), a label edge router (LER), an ingress router, an egress router, a provider router (e.g., a provider edge router or a provider core router), a virtual router, or another type of router, a gateway, a switch, a firewall, a hub, a bridge, and/or a similar device. In some implementations, the internal components 120 may enable the wireless device 105 to function as a 4G wireless gateway, a 5G wireless gateway, or a 5G wireless repeater. For example, where internal components 120 include facilities for a 5G wireless repeater, the internal components 120 may include facilities to receive a 5G wireless signal, perform an amplification procedure on the signal and transmit the amplified signal. As another example, where internal components 120 include facilities for a 4G wireless gateway, the internal components 120 may include facilities to receive a 4G wireless signal, decode the wireless signal to obtain its encoded data, and transmit the received data using local networking facilities.

The scan button 125 may be provided on a side of the housing 107 and, when depressed, may cause the internal components 120 to begin scanning for a wireless signal. If the scan button 125 is depressed again the internal components 120 may cease scanning for a wireless signal. In some implementations, the scan button 125 may be provided on the left side of the housing 107 or on a front side of the housing 107.

In some embodiments, the housing 107 may include bumpers 130. The bumpers 130 may be connected to a rear portion of the wireless device 105 and may be provided at four corners of the rear portion, as better shown in FIG. 1C. The bumpers 130 may be sized and shaped to provide support for the wireless device 105 if the wireless device 105 is not connected to the bracket 110, but instead is placed on a horizontal object (e.g., a desk, a table, a countertop, a shelf, and/or the like). For example, the bumpers 130 may be sized to support the wireless device 105 and to protect the wireless device 105 from a supporting horizontal object. In some implementations, each of the bumpers 130 may include a thickness from approximately two millimeters to approximately six millimeters, a thickness of approximately four millimeters, and/or the like. The bumpers 130 may be hemispherical shaped, square shaped, rectangular shaped, and/or the like. The bumpers 130 may be made from a variety of materials, such as, for example, a plastic material (e.g., a thermoplastic polyurethane (TPU)), a metal material, a rubber material, and/or the like.

The rotation extension 135 of the wireless device 105 may connect to and extend away from the housing 107. The rotation extension 135 may connect to or be integrally formed with the housing 107. The rotation extension 135 may be sized and shaped to rotatably attach to a portion of the bracket 110. For example, the rotation extension 135 may be sized based on the size of the housing 107 and may be cylindrical shaped, square shaped, rectangular shaped, and/or the like. In some implementations, the rotation extension 135 may include a cylinder with a diameter that is from approximately forty-six millimeters to approximately fifty-two millimeters, a diameter that is approximately forty-nine millimeters, and/or the like. The rotation extension 135 may be made from a variety of materials, such as, for example, a plastic material, a metal material, a rubber material, and/or the like. As further shown in the left-side view or the right-side view of FIG. 1B, the rotation extension 135 may be provided in an opening of a portion of the bracket 110. In some implementations, the rotation extension 135 includes a connector that receives the cable so that the cable may provide communication signals to and/or from the wireless device 105.

In some implementations, the rotation extension 135 may include a slot 140. The slot 140 in the rotation extension 135 is configured to receive a pin lock of the bracket 110, described below, to lock in place and prevent rotation of the rotation extension 135 and the wireless device 105. The rotation extension 135 may be rotated to position the wireless device 105 and, once a position is determined, the slot 140 and the pin lock may be utilized to lock the wireless device 105 at the position. As further shown in FIG. 1B, the rotation extension 135 may attach to the bracket 110 so that the wireless device 105 is spaced apart by a distance from the object. The spaced distance may be determined to prevent potential wireless interference by the object with the wireless device 105. In some implementations, the distance is from approximately seventy-three millimeters to approximately eighty-one millimeters, is approximately seventy-seven millimeters, and/or the like. In some implementations, the distance may depend on a material associated with the object to which the wireless device 105 and the bracket 110 are attached. For example, if the wireless device 105 is attached to a window with low-emissivity (low-E) glass, the low-E glass may cause wireless interference for the wireless device. In such an example, the distance may prevent the potential wireless interference by the low-E glass with the wireless device 105.

Figure 1C:
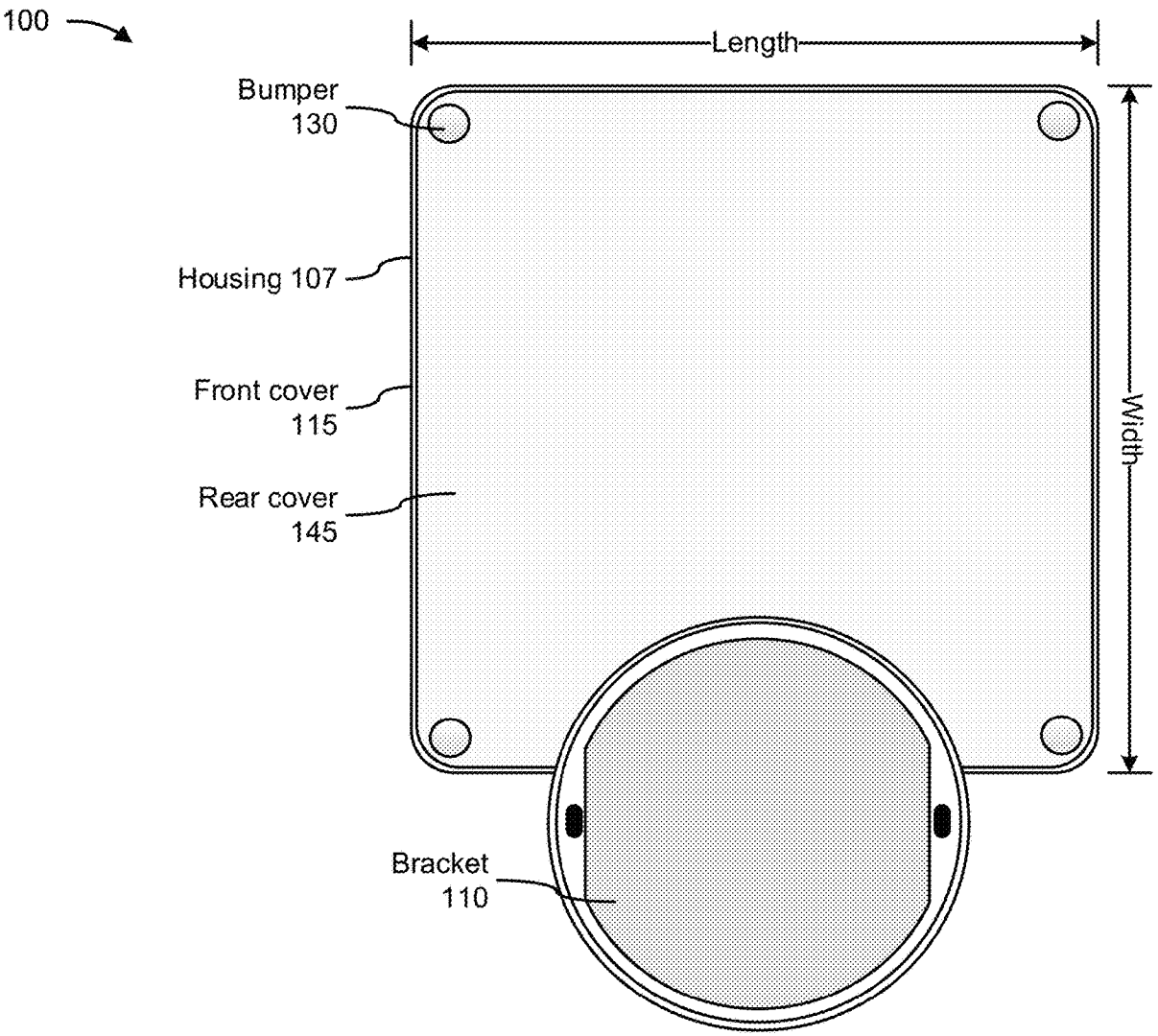

FIG. 1C is a diagram depicting a rear view of the wireless device 105 and the bracket 110. As shown in FIG. 1C, the housing 107 may include rear cover 145 that connects with the other components of the housing 107 to form an enclosed housing for the internal components 120. For example, in some implementations, the front cover 115 may form front and side faces of the housing 107, and the rear cover 145 may mate with the front cover 115 to form the housing 107. The rear cover 145 may be square shaped, rectangular shaped, circular shaped, oval shaped, and/or the like. The rear cover 145 may be sized and shaped in order to allow insertion/removal of internal components 120 of the wireless device 105. For example, the rear cover 145 may be sized based on the size of and/or a quantity of the internal components 120 housed within housing 107. In some implementations, the size and/or shape of the rear cover 145 may be similar to the size and/or shape of the front side of housing 107. The rear cover 145 may be made from a variety of materials that permit radio frequency waves to communicate with the internal components 120, such as, for example, a plastic material, a metal material, a rubber material, and/or the like.

As further shown in FIG. 1C, the housing 107 may include a length and a width. The length may be from approximately one-hundred and seventy-three millimeters to approximately one-hundred and ninety-one millimeters, may be approximately one-hundred and eighty-two millimeters, and/or the like. The width may be from approximately one-hundred and seventy-three millimeters to approximately one-hundred and ninety-one millimeters, may be approximately one-hundred and eighty-two millimeters, and/or the like.

As further shown in FIG. 1C, the bumpers 130 may be attached at the four corners of the rear cover 145. In some implementations, additional bumpers 130 or fewer bumpers 130 may be provided than shown in FIG. 1C or the bumpers 130 may be arranged differently than shown in FIG. 1C.

Figure 1D:
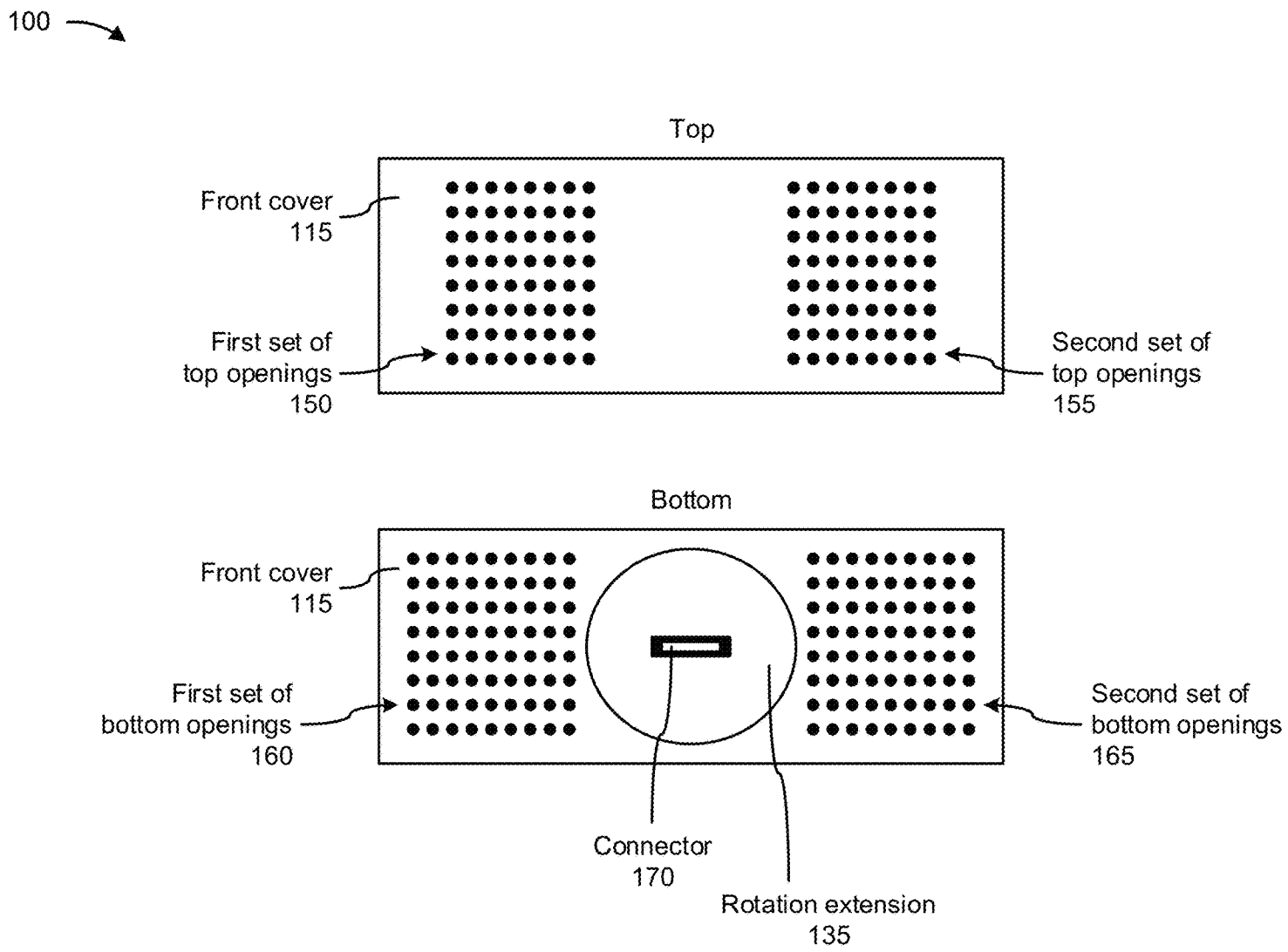

FIG. 1D is a diagram depicting a top view and a bottom view of the wireless device 105. As shown in the top view of the wireless device 105, the top portion of the housing 107 may include a first set of top openings 150 and a second set of top openings 155. A quantity, an arrangement, and sizes of the first set of top openings 150 and the second set of top openings 155 may depend on a quantity of heat generated by the internal components 120 of the wireless device 105. For example, the quantity, the arrangement, and the sizes of the first set of top openings 150 and the second set of top openings 155 may be determined so that the first set of top openings 150 and the second set of top openings 155 provide ventilation for and allow the dissipation of heat from the internal components 120 of the wireless device 105.

As shown in the bottom view of the wireless device 105, the bottom portion of the housing 107 may include a first set of bottom openings 160 and a second set of bottom openings 165, provided on either side of the rotation extension 135. A quantity, an arrangement, and sizes of the first set of bottom openings 160 and the second set of bottom openings 165 may depend on a quantity of heat generated by the internal components 120 of the wireless device 105. For example, the quantity, the arrangement, and the sizes of the first set of bottom openings 160 and the second set of bottom openings 165 may be determined so that the first set of bottom openings 160 and the second set of bottom openings 165 provide ventilation for and allow for the dissipation of heat from the internal components 120 of the wireless device 105. In some implementations, the openings (e.g., the first set of top openings 150, the second set of top openings 155, the first set of bottom openings 160, and the second set of bottom openings 165) may not be provided on the top portion and the bottom portion of the housing 107, but may be provided on the left side and the right side of the housing 107. In some implementations, a quantity and/or sizes of the openings may be configured to maintain an operating temperature of the internal components 120 within a threshold operating temperature range.

In implementations where the housing 107 comprises a front cover 115 that includes a front and one or more sides of the housing 107, the openings (e.g., the first set of top openings 150, the second set of top openings 155, the first set of bottom openings 160, and the second set of bottom openings 165) may be present as part of the one or more sides of the front cover 115.

As further shown in FIG. 1D, the rotation extension 135 may include a connector 170 that receives and connects with the cable (e.g., shown in FIG. 1A) so that the cable may provide to the wireless device 105. The connector 170 may include various types of connectors depending on the cable utilized with the wireless device 105. In some implementations, the internal components 120 may include a power source (e.g., a battery) that provides power to the wireless device 105. In some embodiments, the connector 170 may include data communications connections such that data received/transmitted by wireless device 105 can be sent to/received from wireless device 105 at its deployment location using a cable.

As indicated above, FIGS. 1A-1D are provided as an example. Other examples may differ from what is described with regard to FIGS. 1A-1D. The number and arrangement of components shown in FIGS. 1A-1D are provided as an example. In practice, there may be additional components, fewer components, different components, or differently arranged components than those shown in FIGS. 1A-1D.

Figure 2A:
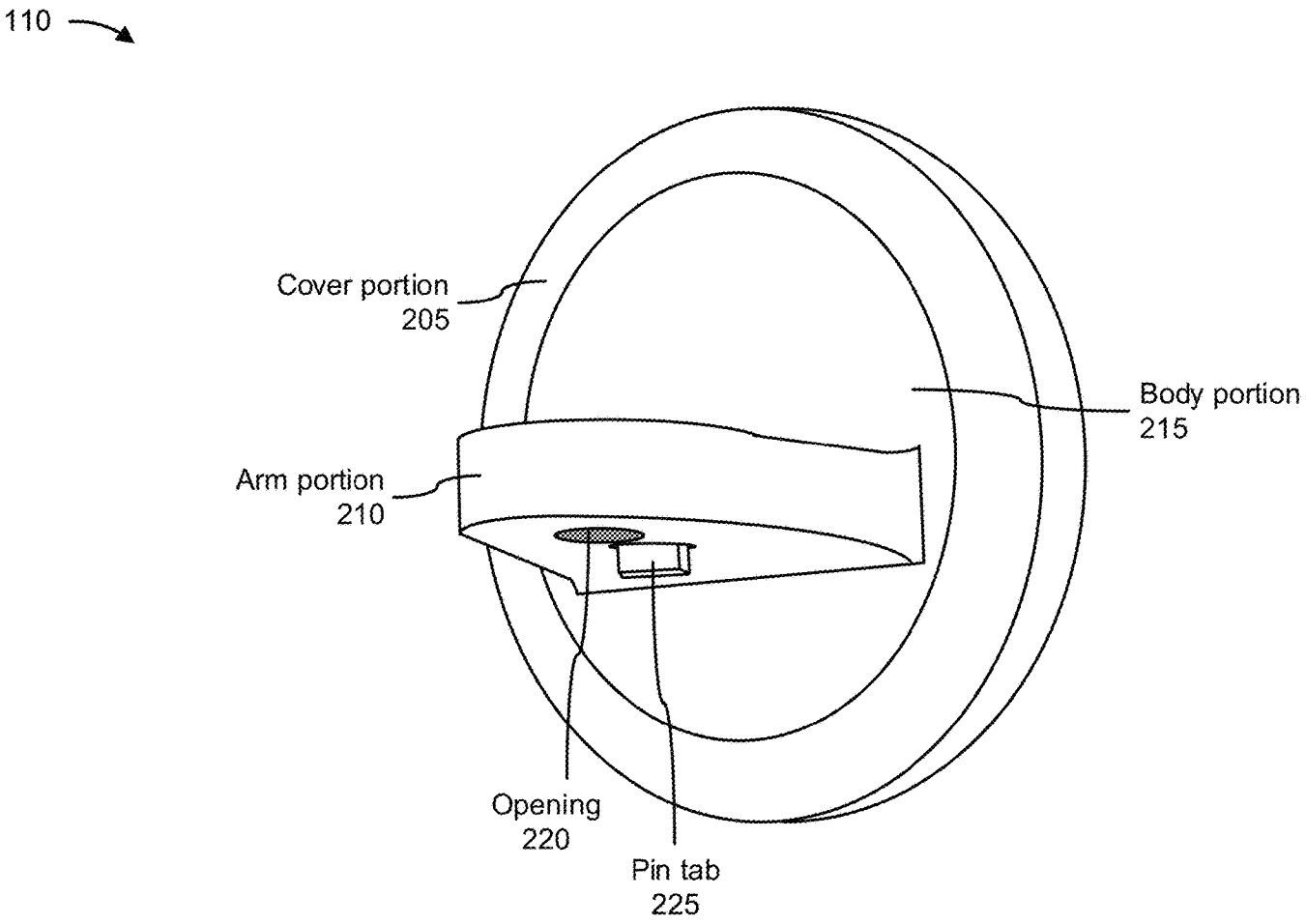
FIGS. 2A-2E are diagrams of the example bracket for mounting the wireless network device.

FIGS. 2A-2E are diagrams of an example associated with the bracket 110 for mounting the wireless device 105. As shown in FIG. 2A, the bracket 110 may include a cover portion 205, an arm portion 210, a body portion 215, an opening 220, and a pin tab 225.

Figure 2B:
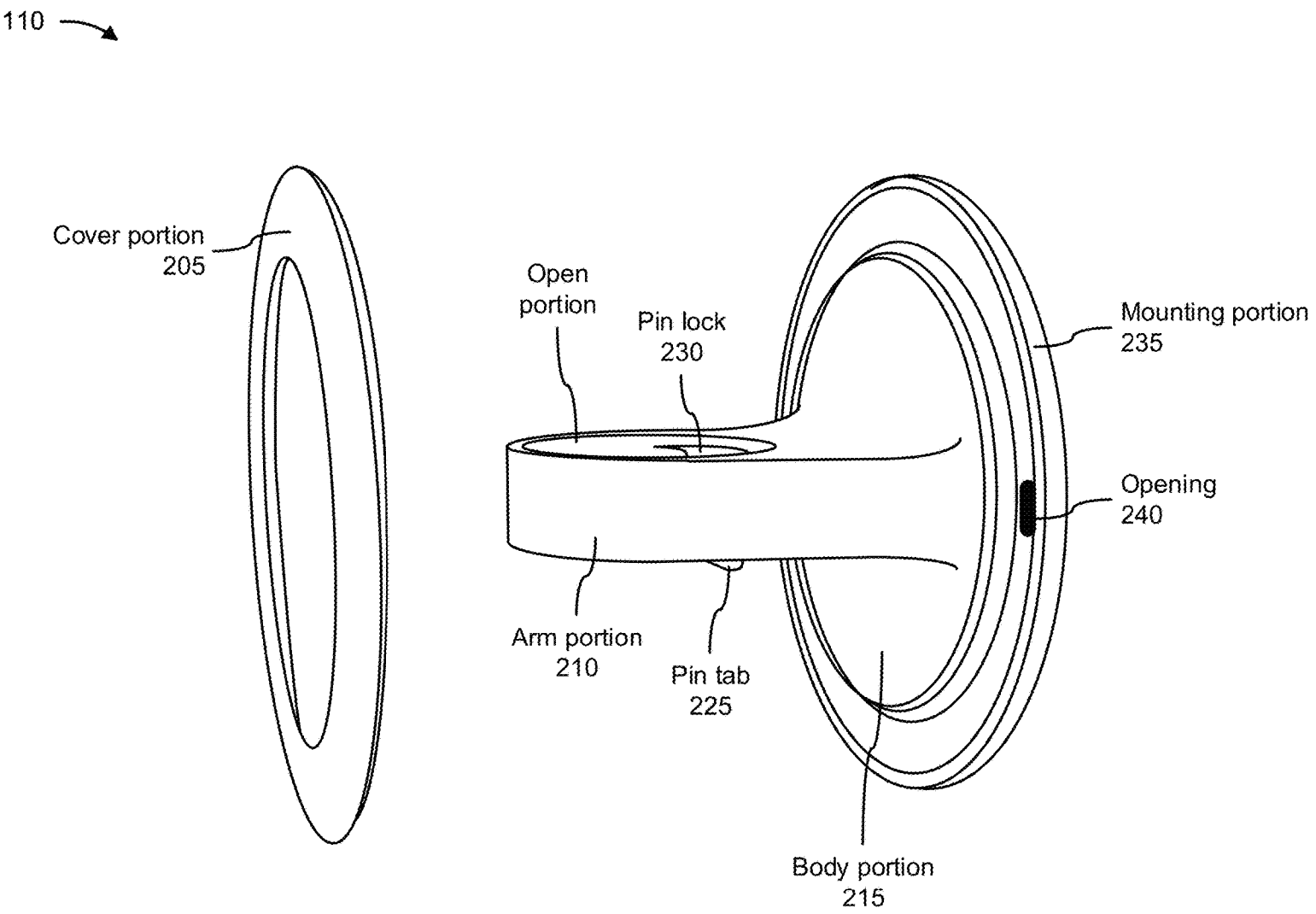

The cover portion 205 may be sized and shaped to connect to and cover a mounting portion of the bracket 110 (e.g., as shown in FIG. 2B). For example, the cover portion 205 may be sized based on the size of the wireless device 105. In some implementations, the cover portion 205 may include an outer diameter that is from approximately one-hundred and four millimeters to approximately one-hundred and sixteen millimeters, a diameter that is approximately one-hundred and ten millimeters, and/or the like. The cover portion 205 may be square shaped, rectangular shaped, circular shaped, oval shaped, and/or the like. The cover portion 205 may be made from a variety of materials, such as, for example, a plastic material, a metal material, a rubber material, and/or the like.

Figure 2C:
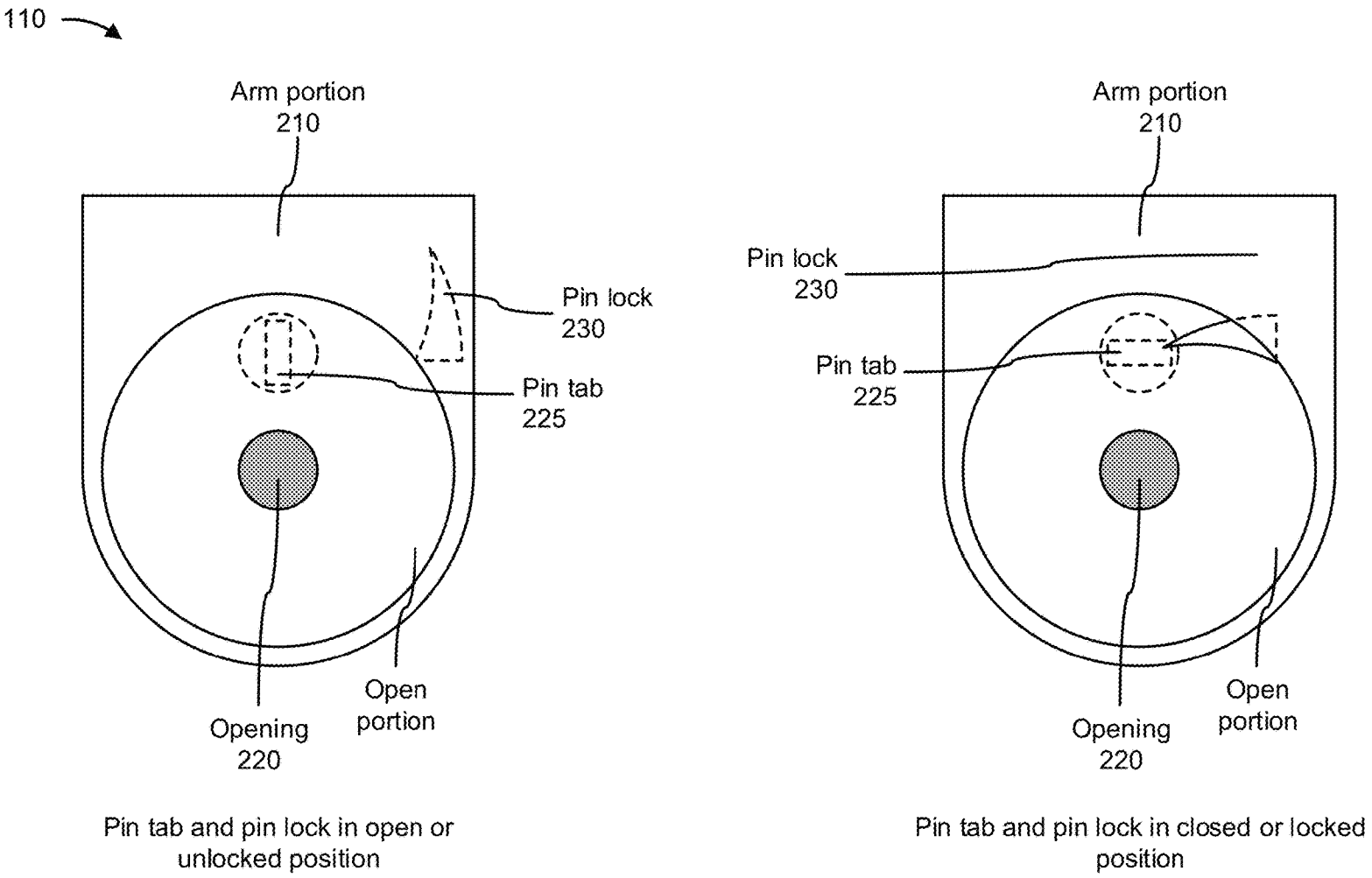

The arm portion 210 may connect to or be integrally formed with the body portion 215. The arm portion 210 may be sized and shaped to receive and retain the rotation extension 135 of the wireless device 105. A top portion of the arm portion 210 may include an open portion (e.g., as shown in FIG. 2C) that is sized and shaped to receive and retain the rotation extension 135 of the wireless device 105. The arm portion 210 may also include an opening 220 on a bottom portion of the arm portion 210 that extends into the open portion, such that a connector 170 of a rotation extension 135 inserted into the open portion is exposed and a cable may be connected with the connector 170. The arm portion 210 may be sized based on the size and shape of the rotation extension 135. In some implementations, the arm portion 210 may include a length (e.g., extending away from the body portion 215) that is from approximately seventy-three millimeters to approximately eighty-one millimeters, is approximately seventy-seven millimeters, and/or the like. The length of the arm portion 210 may be determined to prevent interference with wireless signals by an object to which the bracket 110 is attached, such as described above. The arm portion 210 may be square shaped, rectangular shaped, semi-circular shaped, oval shaped, and/or the like. The arm portion 210 may be made from a variety of materials, such as, for example, a plastic material, a metal material, a rubber material, and/or the like.

The body portion 215 may be sized and shaped to connect to the mounting portion of the bracket 110 (e.g., as shown in FIG. 2B) and to connect to or be integrally formed with the arm portion 210. For example, the body portion 215 may be sized based on the size of the wireless device 105. The body portion 215 may be square shaped, rectangular shaped, circular shaped, oval shaped, and/or the like. In some implementations, the body portion 215 may include an outer size that is less than the outer size of the cover portion 205. For example, where the body portion 215 is circular (such as shown in FIG. 2B), its outer diameter may be smaller than an outer diameter of the cover portion 205. The body portion 215 may be made from a variety of materials, such as, for example, a plastic material, a metal material, a rubber material, and/or the like.

A pin tab 225 may be provided through an opening in the bottom portion of the arm portion 210 and may coupled to a pin lock (e.g., as shown in FIGS. 2B and 2C). The pin tab 225 may manipulate the pin lock to and from a locked position and an unlocked position to lock in place and prevent rotation of the rotation extension 135 of the wireless device 105.

FIG. 2B is a perspective view of the bracket 110 with the cover portion 205 removed. As shown, the bracket 110 may include a pin lock 230 that communicates with the pin tab 225, and the bracket may include a mounting portion 235 (e.g., with an opening 240) connected to the body portion 215. As further shown, the arm portion 210 may include an open portion that is sized and shaped to receive and retain the rotation extension 135 of the wireless device 105.

The pin lock 230 may be provided within the slot 140 of the rotation extension 135 to lock in place and prevent rotation of the rotation extension 135 and the wireless device 105. The rotation extension 135 may be rotated to position the wireless device 105 and, once a position is determined, the slot 140 and the pin lock 230 may be utilized to lock the wireless device 105 at the position. The pin tab 225 may manipulate the pin lock 230 to and from a locked position and an unlocked position to lock in place and prevent rotation of the rotation extension 135.

The mounting portion 235 may be sized and shaped to connect to the cover portion 205 and the body portion 215 of the bracket 110. For example, the mounting portion 235 may be sized based on the size of the wireless device 105. The mounting portion 235 may be square shaped, rectangular shaped, circular shaped, oval shaped, and/or the like. In some implementations, the mounting portion 235 may be circular in shape and include an outer diameter that is from approximately one-hundred and four millimeters to approximately one-hundred and sixteen millimeters, a diameter that is approximately one-hundred and ten millimeters, and/or the like. The mounting portion 235 may be made from a variety of materials, such as, for example, a plastic material, a metal material, a rubber material, and/or the like. The opening 240 may be provided in the mounting portion 235 so that the mounting portion 235 may be connected with the object via a fastener (e.g., a screw, a bolt, and/or the like). The mounting portion 235 may include one or more openings 240.

FIG. 2C depicts top views of the arm portion 210 of the bracket 110. The left side of FIG. 2C depicts the pin tab 225 and the pin lock 230 in an open or unlocked position. In the unlocked position, the pin tab 225 is at a first orientation and the pin lock 230 is not provided in the open portion of the arm portion 210 and thus cannot be received in the slot 140 of the rotation extension 135. The pin tab 225 may be manipulated to the first orientation and may cause the pin lock 230 to be provided in the unlocked position.

The right side of FIG. 2C depicts the pin tab 225 and the pin lock 230 in a closed or locked position. In the locked position, the pin tab 225 is at a second orientation and the pin lock 230 is provided in the open portion of the arm portion 210 and thus can be received in the slot 140 of the rotation extension 135. Provision of the pin lock 230 in the slot 140 may lock in place and prevent rotation of the rotation extension 135. The pin tab 225 may be manipulated to the second orientation and may cause the pin lock 230 to be provided in the locked position.

Figure 2D:
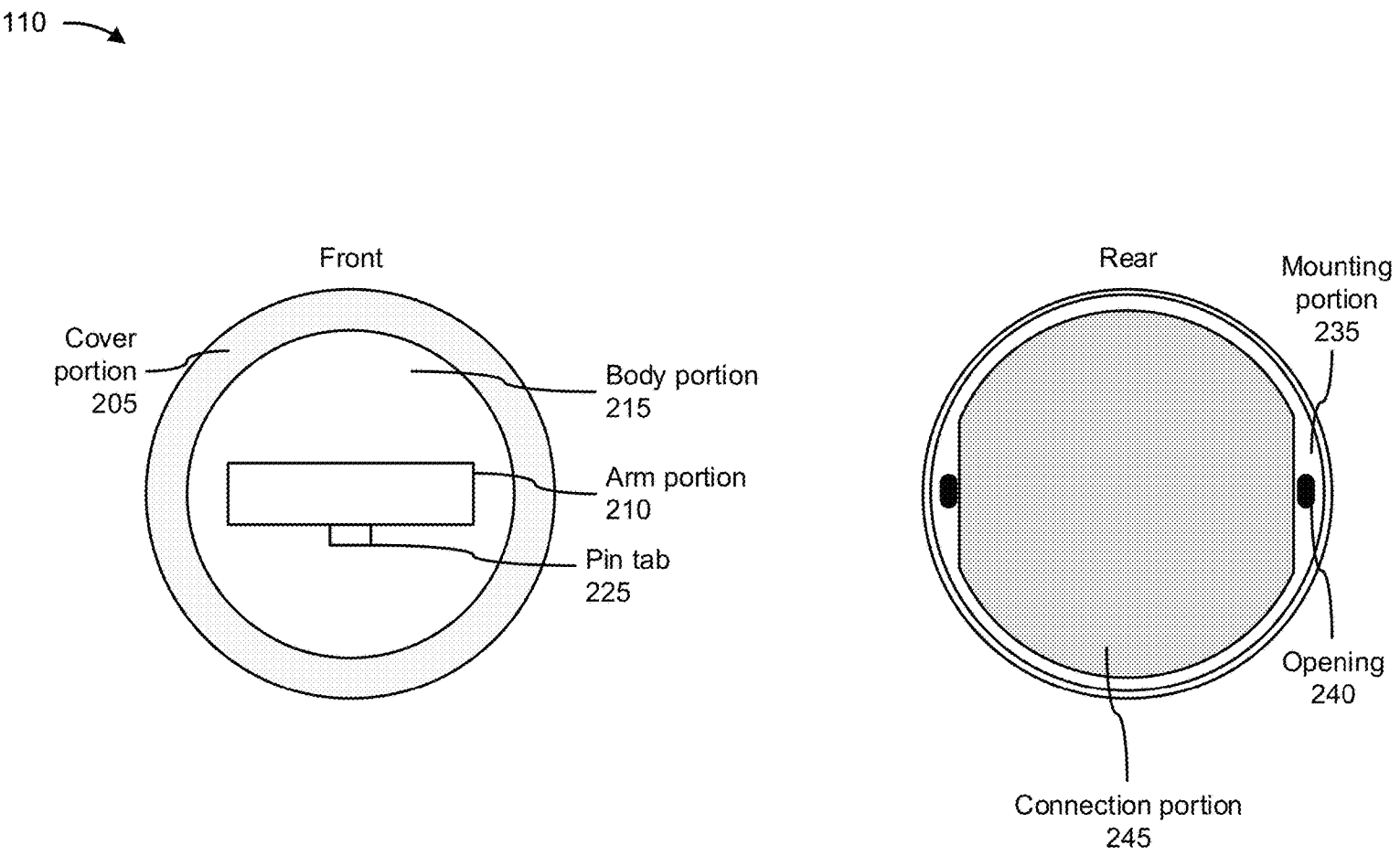

FIG. 2D depicts a front view and a rear view of the bracket 110. As shown in the front view, the bracket 110 includes the cover portion 205, the arm portion 210, the body portion 215, and the pin tab 225, described above. As shown in the rear view, the bracket 110 includes the mounting portion 235 and the opening 240, described above, and a connection portion 245.

In some implementations, the bracket 100 may include a connection portion 245, which may be used to enable an easier and stronger connection between bracket 110 and the to object to which it is connected. The connection portion 245 may be sized and shaped to connect to the mounting portion 235 of the bracket 110. For example, the connection portion 245 may be sized based on the size of the wireless device 105. The connection portion 245 may be square shaped, rectangular shaped, circular shaped, oval shaped, and/or the like. In some implementations, the connection portion 245 may by cylindrical in shape and include an outer diameter that is from approximately one-hundred and four millimeters to approximately one-hundred and sixteen millimeters, a diameter that is approximately one-hundred and ten millimeters, and/or the like. The connection portion 245 may be made from a variety of materials, such as, for example, a plastic material, a metal material, a rubber material, and/or the like.

Figure 2E:
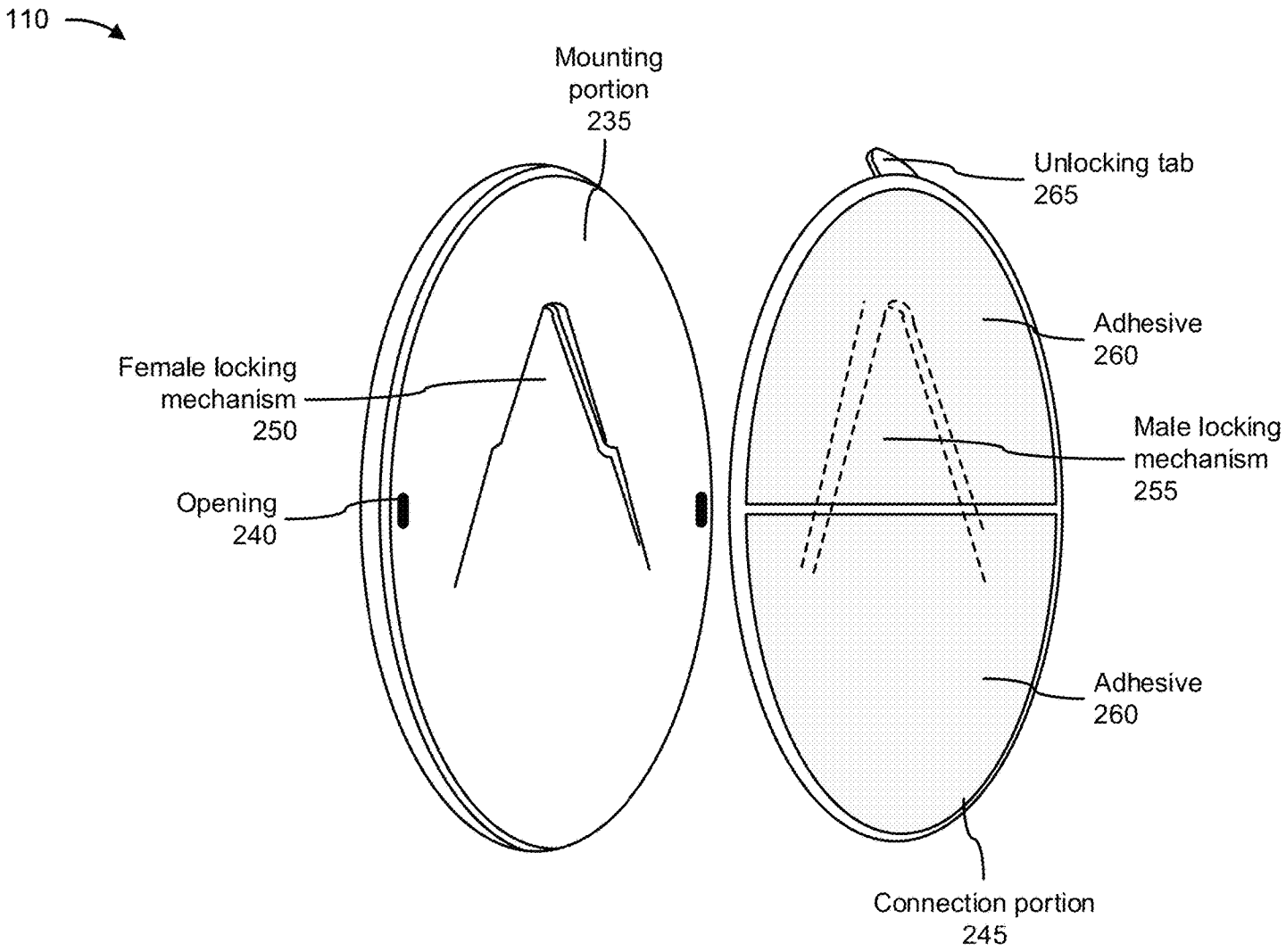

FIG. 2E is a perspective view of an example of a mounting portion 235 and connection portion 245 of the bracket 110. As shown, the mounting portion 235 may include the opening, described above. The mounting portion 235 may also include a female locking mechanism 250. The connection portion 245 may include a male locking mechanism 255, an adhesive 260, and an unlocking tab 265.

The female locking mechanism 250 may be sized and shaped to receive and retain the male locking mechanism 255 of the connection portion 245. For example, the male locking mechanism 255 may be an inverted-V shape wedge with a retaining lip, while the female locking mechanism 250 may be an inverted-V shape void with a retaining lip, such that the female locking mechanism 250 may connect with the male locking mechanism 255 by sliding the mounting portion into the connection portion until the retaining lips engage. When the inverted-V-shaped locking mechanism is vertically oriented (i.e., in the direction of gravity), the force of gravity will keep the mounting portion engaged with the connection portion 245. One of the benefits of the this connection mechanism is that it is self-guiding in that once the mounting portion is slid onto the connection portion, the inverted-V shape will cause the mounting portion to move into the correct position to cause the male and female locking mechanisms to engage. Other shapes for the connection mechanism may also be possible (e.g., an inverted-U-shape), where such shapes allow for sliding of the mounting portion 235 onto the connector portion 245 in a self-guiding manner to create a connection.

The adhesive 260 may include a material that may securely adhere to a surface of the object and retain the connection portion 245, the wireless device 105, and the bracket 110 on the object. For example, the adhesive 260 may include a tape (e.g., "gecko tape"), a glue, a rubber, and/or the like. In some implementations, the adhesive 260 may be replaced with another connection mechanism, such as one or more suction cups.

The unlocking tab 265 may connect to the connection portion 245 and may be manipulated (e.g., pulled on) to remove the connection portion 245 from the object when the bracket 110 needs to removed and/or relocated.

As indicated above, FIGS. 2A-2E are provided as an example. Other examples may differ from what is described with regard to FIGS. 2A-2E. The number and arrangement of components shown in FIGS. 2A-2E are provided as an example. In practice, there may be additional components, fewer components, different components, or differently arranged components than those shown in FIGS. 2A-2E.

In this way, the wireless device 105 may be mounted in the bracket 110 and be locked in place in the bracket 110 with the pin tab 225 and the pin lock 230. The bracket 110 may space the wireless device 105 from a window or a wall (e.g., to which the bracket 110 is attached) to enable acquiring a telecommunications signal (e.g., a 5G network signal). The wireless device 105 may include a 5G receiver and a 5G router built into a single housing. The bracket 110 may include the female locking mechanism 250 that communicates with the male locking mechanism 255 (e.g., connected to a window or a wall) to enable easier installation of the bracket 110. The bracket 110 may connect to the wireless device 105 and enable the wireless device 105 to rotate towards and away from the bracket 110. Thus, the wireless device 105 and the bracket 110 may conserve computing resources, networking resources, and other resources that would have otherwise been consumed by rebooting the wireless device 105, reconnecting with user devices and an external network, losing network traffic during the rebooting and reconnecting with the user devices and the external network, and/or the like.

As an example of the operation of the example wireless device 105 and bracket 110 as part of an installation, a user may provide the rotation extension 135 of the wireless device 105 into the open portion of the arm portion 210 of the bracket 110 and may connect a cable to the connector 170 of the rotation extension 135. The user may hold the wireless device 105 and the bracket 110 against an object (e.g., a window) and may press the scan button 125 of the wireless device 105 to start signal scanning. An indicator (e.g., a light-emitting diode (LED) provided on the front cover 115 of the wireless device 105) may change colors to indicate a good signal (e.g., green), a poor signal (e.g., yellow), and no or bad signal (e.g., red). If necessary, the user may adjust the position of the wireless device 105 and the bracket 110 on the object and repeat the signal scanning process. If the indicator indicates a good signal, the user may mark a position of the bracket 110 on the object.

The user may remove the connection portion 245 from the bracket 110 (e.g., from the mounting portion 235) and may remove a backing from the adhesive 260 from the connection portion 245. The user may then adhere the connection portion 245 to the object (e.g., at the position marked by the user) with the adhesive 260. The user may reattach the bracket 110 to the connection portion 245 by aligning and attaching the female locking mechanism 250 of the mounting portion 235 to the male locking mechanism 255 of the connection portion 245. The user may adjust an angle of the wireless device 105 by rotating the rotation extension 135. Once an optimal position is determined, the user may turn the pin tab 225 to the locked position so that the pin lock 230 engages the slot 140 of the rotation extension 135 and locks in place and prevents rotation of the rotation extension 135. The user may press the scan button 125 of the wireless device 105 to confirm receipt of a signal.

The user may install the wireless device 105 and the bracket 110 in a similar manner without utilizing the connection portion 245 of the bracket, such as may be possible with an object that allows for inserting attachment hardware (e.g., a wall that can receive screws, nails, or other fasteners). In a wall installation, the user may utilize fasteners through the openings 240 of the mounting portion 235 to attach the mounting portion 235 to the wall.

Figure 3:
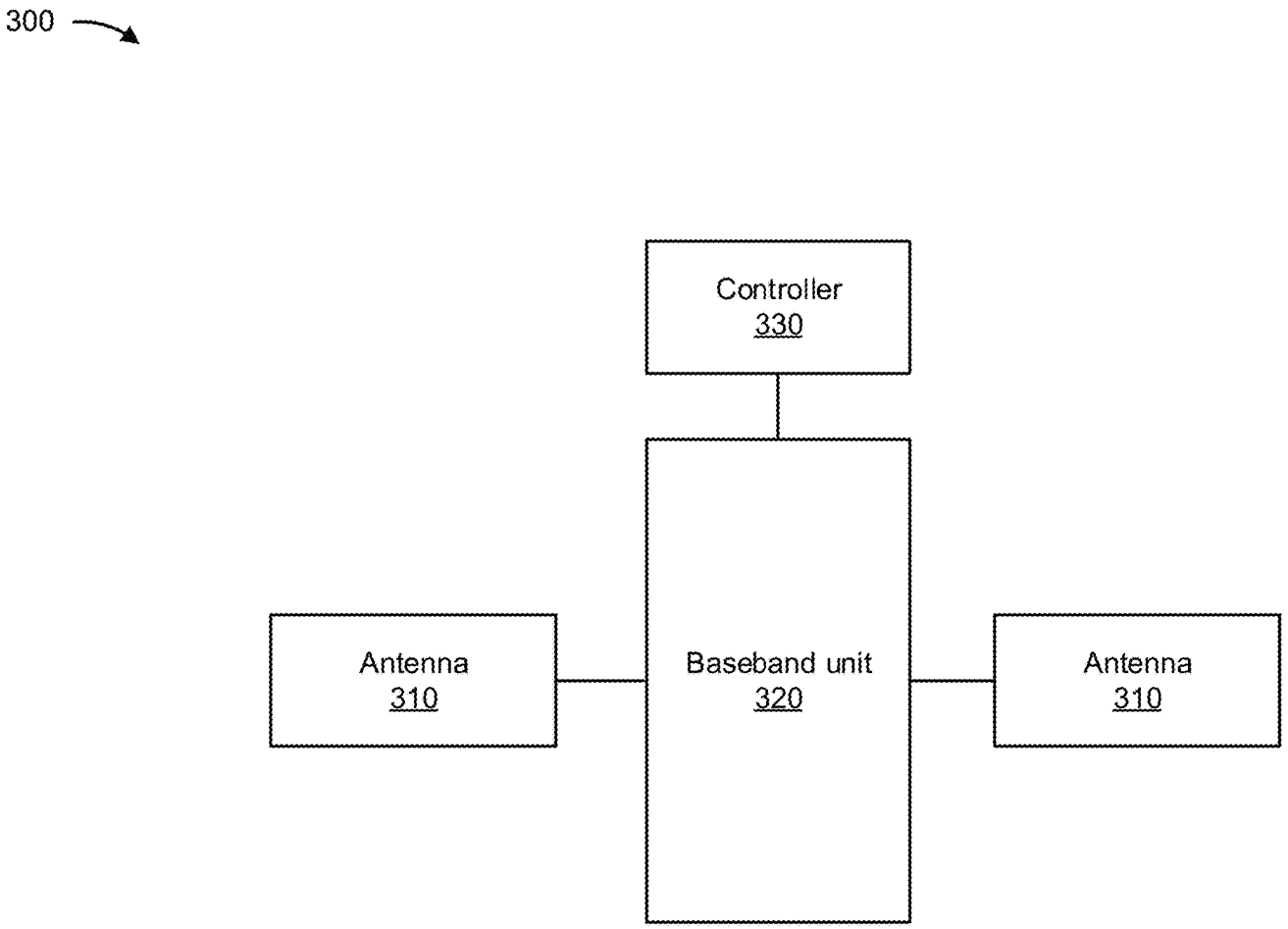
FIG. 3 is a diagrams of example components of the wireless network device of FIGS. 1A-1D.

FIG. 3 is a diagram of example components of the wireless device 105 of FIGS. 1A-1D. The wireless device 105 may include a device 300. In some implementations, the wireless device 105 may include one or more devices 300 and/or one or more components of the device 300. As shown in FIG. 3, device 300 may include one or more input antennas 310, a baseband unit 320, and a controller 330.

The antenna 310 rebroadcasts and captures wireless signals that the wireless device 105 produces. In some implementations, the wireless device 105 may include at least two antennas 310. A first antenna 310 may transmit a wireless signal and a second antenna 310 may broadcast the wireless signal.

The baseband unit 320 includes a telecommunication network component used to process baseband signals. Baseband is a term used to describe an original frequency of a transmission prior to modulation. A radio access network (RAN) includes a baseband unit connected to one or more remote radio units positioned near antennas. The baseband unit 320 may act as a centralized hub that processes uplink and downlink data traffic and controls functionality of the antennas 310. The baseband unit 320 may include a digital signal processor used to convert signals from analog to digital or vice versa.

The controller 330 includes a processor in the form of, for example, a CPU, a GPU, an APU, a microprocessor, a microcontroller, a DSP, an FPGA, an ASIC, and/or another type of processor. The processor is implemented in hardware, firmware, or a combination of hardware and software. In some implementations, the controller 330 may include one or more processors that can be programmed to perform a function.

In some implementations, the controller 330 may include a RAM, a ROM, and/or another type of dynamic or static storage device (e.g., a flash memory, a magnetic memory, an optical memory, etc.) that stores information and/or instructions for use by the controller 330. In some implementations, the controller 330 may communicate with other devices, networks, and/or systems connected to device 300 to exchange information regarding network topology.

The controller 330 may perform one or more processes described herein. The controller 330 may perform these processes in response to executing software instructions stored by a non-transitory computer-readable medium. A computer-readable medium is defined herein as a non-transitory memory device. A memory device includes memory space within a single physical storage device or memory space spread across multiple physical storage devices.

Software instructions may be read into a memory and/or storage component associated with the controller 330 from another computer-readable medium or from another device via a communication interface. When executed, software instructions stored in a memory and/or storage component associated with the controller 330 may cause the controller 330 to perform one or more processes described herein. Additionally, or alternatively, hardwired circuitry may be used in place of or in combination with software instructions to perform one or more processes described herein. Thus, implementations described herein are not limited to any specific combination of hardware circuitry and software.

The number and arrangement of components shown in FIG. 3 are provided as an example. In practice, device 300 may include additional components, fewer components, different components, or differently arranged components than those shown in FIG. 3. Additionally, or alternatively, a set of components (e.g., one or more components) of device 300 may perform one or more functions described as being performed by another set of components of device 300.

As used herein, the term "component" is intended to be broadly construed as hardware, firmware, or a combination of hardware and software. It will be apparent that systems and/or methods described herein may be implemented in different forms of hardware, firmware, and/or a combination of hardware and software. The actual specialized control hardware or software code used to implement these systems and/or methods is not limiting of the implementations. Thus, the operation and behavior of the systems and/or methods are described herein without reference to specific software code—it being understood that software and hardware can be used to implement the systems and/or methods based on the description herein.

As used herein, satisfying a threshold may, depending on the context, refer to a value being greater than the threshold, greater than or equal to the threshold, less than the threshold, less than or equal to the threshold, equal to the threshold, not equal to the threshold, or the like.

Even though particular combinations of features are recited in the claims and/or disclosed in the specification, these combinations are not intended to limit the disclosure of various implementations. In fact, many of these features may be combined in ways not specifically recited in the claims and/or disclosed in the specification. Although each dependent claim listed below may directly depend on only one claim, the disclosure of various implementations includes each dependent claim in combination with every other claim in the claim set. As used herein, a phrase referring to "at least one of" a list of items refers to any combination of those items, including single members. As an example, "at least one of: a, b, or c" is intended to cover a, b, c, a-b, a-c, b-c, and a-b-c, as well as any combination with multiple of the same item.

No element, act, or instruction used herein should be construed as critical or essential unless explicitly described as such. Also, as used herein, the articles "a" and "an" are intended to include one or more items and may be used interchangeably with "one or more." Further, as used herein, the article "the" is intended to include one or more items referenced in connection with the article "the" and may be used interchangeably with "the one or more." Furthermore, as used herein, the term "set" is intended to include one or more items (e.g., related items, unrelated items, or a combination of related and unrelated items), and may be used interchangeably with "one or more." Where only one item is intended, the phrase "only one" or similar language is used. Also, as used herein, the terms "has," "have," "having," or the like are intended to be open-ended terms. Further, the phrase "based on" is intended to mean "based, at least in part, on" unless explicitly stated otherwise. Also, as used herein, the term "or" is intended to be inclusive when used in a series and may be used interchangeably with "and/or," unless explicitly stated otherwise (e.g., if used in combination with "either" or "only one of").

In the preceding specification, various example embodiments have been described with reference to the accompanying drawings. It will, however, be evident that various modifications and changes may be made thereto, and additional embodiments may be implemented, without departing from the broader scope of the invention as set forth in the claims that follow. The specification and drawings are accordingly to be regarded in an illustrative rather than restrictive sense.

What is claimed is:

1. A device, comprising:

a housing with a plurality of top openings provided in a top portion of the housing and a plurality of bottom openings provided in a bottom portion of the housing;

one or more internal components provided within the housing, the internal components providing a wireless communications service;

a rotation extension connected to the bottom portion of the housing and configured to rotatably attach to a bracket that mounts the device to an object, wherein an opening is configured to receive and retain the rotation extension, and wherein a pin tab is configured to adjust a pin lock associated with locking the rotation extension; and a connector connected to the rotation extension and configured to receive a cable that provides communication signals to and from the internal components.

2. The device of claim 1, wherein the one or more internal components include at least one of a fifth-generation wireless network receiver and a router.

3. The device of claim 1, wherein the object includes one of a window or a wall.

4. The device of claim 1, wherein the plurality of top openings include a first set of top openings and a second set of top openings spaced from the first set of top openings, and wherein the plurality of bottom openings includes a first set of bottom openings and a second set of bottom openings spaced from the first set of bottom openings.

5. The device of claim 1, wherein the plurality of top openings and the plurality of bottom openings are configured to provide ventilation for the one or more internal components provided within the housing.

6. The device of claim 1, wherein the rotation extension is configured to be locked in place to prevent rotation of the housing.

7. The device of claim 6, wherein the rotation extension includes a slot configured to receive the pin lock of the bracket to lock in place and prevent rotation of the housing.

8. The device of claim 1, wherein an arm portion of the bracket is configured to be attached to the rotation extension so that the housing is spaced apart by a distance from the object to prevent radio frequency interference by the object with the internal components.

9. The device of claim 1, wherein the pin tab configured to adjust the pin lock is further configured to move the pin lock to and from a locked position and an unlocked position.

10. A bracket for mounting a device to an object, the bracket comprising:

a connection portion including:

an adhesive to connect the connection portion to the object; and a male locking mechanism;

a mounting portion including a female locking mechanism to receive and retain the male locking mechanism of the connection portion and to connect the mounting portion to the connection portion;

a body portion configured to connect to the mounting portion; and an arm portion connected to the body portion and including:

an opening to receive and retain a cylindrical rotation extension of the device, a pin lock configured to lock in place and prevent rotation of the cylindrical rotation extension of the device, and a pin tab configured to manipulate the pin lock to and from a locked position and an unlocked position.

11. The bracket of claim 10, wherein each of the female locking mechanism and the male locking mechanism are inverted-V-shaped.

12. The bracket of claim 10, wherein the mounting portion includes one or more openings configured to receive one or more fasteners that connect to the object when the adhesive is not utilized to connect the connection portion to the object.

13. The bracket of claim 10, wherein the body portion is integrally formed with the mounting portion.

14. The bracket of claim 10, further comprising:

a cover portion configured to connect to and cover the mounting portion.

15. The bracket of claim 10, wherein the arm portion is configured to attach to the device so that the device is spaced apart by a distance from the object to prevent wireless interference by the object with the device.

16. The bracket of claim 10, wherein the object includes one of a window or a wall.

17. A system, comprising:

a device that includes:

a housing with a plurality of top openings provided in a top portion of the housing and a plurality of bottom openings provided in a bottom portion of the housing, one or more internal components provided within the housing, and a rotation extension connected to the bottom portion of the housing and configured to rotatably attach to a bracket that mounts the device to an object; and the bracket that includes:

a connection portion configured to connect to the object, a mounting portion configured to connect to the connection portion, a body portion configured to connect to the mounting portion, and an arm portion connected to the body portion that includes:

an opening configured to receive and retain the rotation extension, and a pin tab configured to adjust a pin lock associated with locking the rotation extension.

18. The system of claim 17, wherein the rotation extension of the device is configured to be attached to the bracket so that the device is spaced apart by a distance from the object to prevent wireless interference by the object with the device.

19. The system of claim 17, wherein the rotation extension of the device includes a slot configured to receive the pin lock of the bracket to lock in place and prevent rotation of the device.

20. The system of claim 17, the mounting portion of the bracket includes a female locking mechanism to receive and retain a male locking mechanism of the connection portion of the bracket to connect the mounting portion to the connection portion.

* * * * *